US006360699B1

(12) United States Patent
van Dijk et al.

(10) Patent No.: US 6,360,699 B1
(45) Date of Patent: Mar. 26, 2002

(54) DEVICE FOR HEATING FLUID

(75) Inventors: Petrus Martinus van Dijk, Bunnik; Erik Mozes; Gilles Gerardus Hirs, both of Utrecht, all of (NL)

(73) Assignee: Van Dijk Heating B.V., La Bunnik (NL)

( * ) Notice: Subject to any disclaimer, the term of this patent is extended or adjusted under 35 U.S.C. 154(b) by 0 days.

(21) Appl. No.: 09/555,227

(22) PCT Filed: Nov. 26, 1998

(86) PCT No.: PCT/NL98/00673

§ 371 Date: Jul. 21, 2000

§ 102(e) Date: Jul. 21, 2000

(87) PCT Pub. No.: WO99/27309

PCT Pub. Date: Jun. 3, 1999

(30) Foreign Application Priority Data

Nov. 26, 1997 (NL) ..... 1007623

(51) Int. Cl.[7] ..... F22B 15/00

(52) U.S. Cl. ..... 122/235.35; 122/18.31; 122/216; 122/235.13; 122/235.14; 165/143; 165/144

(58) Field of Search ..... 122/18.1, 18.31, 122/51, 215, 216, 220, 235.11, 235.13, 235.14, 235.16, 235.35, 240.2; 165/108, 143, 144, 145, 146

(56) References Cited

U.S. PATENT DOCUMENTS

| | | | | | |
|---|---|---|---|---|---|
| 1,972,324 | A | | 9/1934 | Smith | |
| 3,608,527 | A | * | 9/1971 | Stiefel | 122/235.11 |
| 3,638,621 | A | * | 2/1972 | Craig | 122/140.1 |
| 4,254,826 | A | * | 3/1981 | Adams | 165/143 |
| 5,951,281 | A | * | 9/1999 | Matsuo | 432/199 |
| 6,116,894 | A | * | 9/2000 | Kolln | 432/59 |

FOREIGN PATENT DOCUMENTS

| | | |
|---|---|---|
| DE | 8609170 | 4/1988 |
| DE | 4406030 | 8/1995 |
| GB | 544563 | 4/1942 |
| WO | WO 96/41101 | 12/1996 |

* cited by examiner

*Primary Examiner*—Gregory Wilson
(74) *Attorney, Agent, or Firm*—Needle & Rosenberg, P.C.

(57) ABSTRACT

Device for heating fluid, comprising: a first section for heating the fluid in which fuel and air are mixed and combusted; a second section for heating the fluid which is disposed substantially in the line of the combustion section and in which a number of pipes for the fluid extend substantially transversely of the flow direction of the combustion gases; and a third section for heating the fluid which is disposed substantially in the line of the second heating section and in which a number of pipes for the fluid extend substantially transversely of the flow direction of the combustion gases, wherein at least a number of the pipes in the third section are provided with ribs or fins enhancing the heat transfer.

15 Claims, 8 Drawing Sheets

DEVICE FOR HEATING FLUID

BACKGROUND OF THE INVENTION

The present invention relates to a heating device, particularly with capacities of 0.5–15 MW, for instance for use in horticulture. Existing heating boilers in this field of application must be transportable by road on a truck, whereby the dimensions thereof are limited. Partly for this reason such heating devices are usually embodied as three-draught boilers, wherein the thermal efficiency and the pressure drop are adversely affected; the fire tube is usually narrow.

DESCRIPTION OF THE RELATED ART

Such a multi-draught boiler is known for instance from the German Offenlegungsschrift DE-A-44 06 030.

Further known from the German Gebrauchsmuster DE-U-86 09 170 is a standing gas heating boiler, wherein pipes of a heat exchanger are partially embedded in insulation material arranged on a wall thereof, so that no condensation will form on this inner wall. This insulation material makes the construction of this known device complicated, while the upright arrangement makes it impossible to transport such a device of sufficient capacity for horticulture purposes.

BRIEF SUMMARY OF THE INVENTION

It is an object of the present invention to improve existing heating devices, to obviate the above stated problems and to provide a heating boiler with a high thermal efficiency and a low pressure drop. It is a further object of the present invention to provide a heating device which can easily be scaled up, comprises a minimum number of preferably standardized components of sheet steel, which is easy to maintain and can function in disturbance-free manner. For combustion with a low $NO_x$ content and CO content the temperature of the flue gas must be optimized, particularly in the furnace. Condensation against the walls of the flue gas part is precluded as far as possible.

The present invention provides a device for heating fluid, comprising:

- a first section for heating the fluid in which fuel and air are mixed and combusted;
- a second section for heating the fluid which is disposed substantially in the line of the combustion section and in which a number of pipes for the fluid extend substantially transversely of the flow direction of the combustion gases; and
- a third section for heating the fluid which is disposed substantially in the line of the second heating section and in which a number of pipes for the fluid extend substantially transversely of the flow direction of the combustion gases, wherein at least a number of the pipes in the third section are provided with ribs or fins enhancing the heat transfer.

The present invention therefore provides a so-called single-draught boiler which, owing to the transverse arrangement of the pipes, does not have to be much longer than the above mentioned three-draught boiler. The fire tube can take a spacious form, whereby it is suitable for burners with low $NO_x$ emission.

Although the pipes can be disposed in successive rows, which is structurally the simplest, it is also possible for the pipes to be successively disposed in offset or crosswise manner in the second and/or third heating circuit. This enhances the heat transfer and, in the case of rows of heating pipes in crosswise arrangement, a symmetrical inflow and heating of the fluid.

In a preferred embodiment baffles with flow passages are situated round the fire tube in order to strengthen the construction and enhance the flow of the fluid for heating in an annular space around the fire tube. The fire tube is hereby also cooled better.

The present invention further provides a method for operating a device for heating fluid, whereinsome of the heated fluid is pumped back to an inlet connection of the device for supplying the fluid for heating.

The method is preferably applied in a device according to the present invention. By means of pumping back some of the heated water the total heat transfer is improved and the pipes are cooled well. Pumping back hot water can ensure, also at low fire-load, that the temperature of the entering water lies above the dew point of about 60° C.

A minimum volume flow can be ensured by switching on the pump, whereby the temperature difference over the boiler can be decreased, which causes a reduction in the thermal stresses in the construction. A maximum temperature difference of 30° C. can be guaranteed.

In a further preferred embodiment the pipes of the second and third section are in roughly the form of a block and placed obliquely in the substantially cylindrical outer wall so that a so-called header is formed, whereby flow through the pipes takes place uniformly.

The first, second and third section are preferably fixed to each other as well as to a front and back end. By removing an annular weld on the front and back end all the internal parts can be pulled out of the substantially cylindrical outer wall.

BRIEF DESCRIPTION OF THE SEVERAL VIEWS OF THE DRAWINGS

Further advantages, features and details of the present invention will be elucidated on the basis of the following description of preferred embodiments thereof with reference to the annexed drawing, in which.

DETAILED DESCRIPTION OF INVENTION

Figure 1:
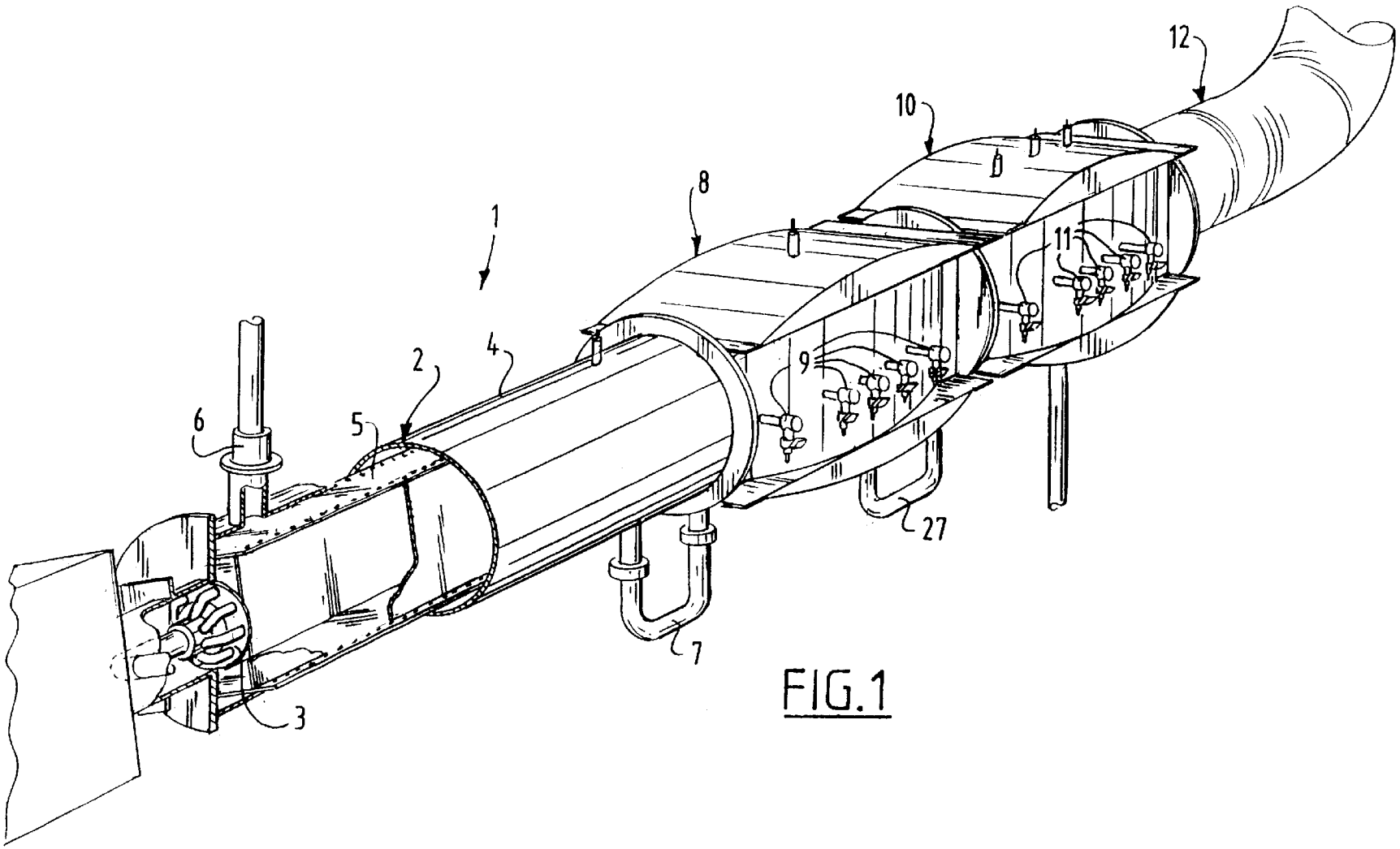
FIG. 1 shows a partly broken away view in perspective of a first preferred embodiment of a heating device according to the present invention.

A device 1 (FIG. 1) according to the present invention comprises in a first section 2 a spacious fire tube in which supplied fuel and air is fired by a burner 3 at a temperature of 1600–1800° C. and subsequently cooled to for instance 1000–1100° C. The inner wall of fire tube 3 is cooled by water discharged and supplied via conduits 6 respectively 7 in the annular space between the inner casing and outer casing 4.

Disposed in the line of section 2 is a second heat exchanger 8 in which the combustion gases of for instance about 1000–1100° C. are cooled to 300–400° C. FIG. 1 shows in this heat exchanger a number of drain conduits 9 for performing measurements on the experimental set-up.

Disposed in the line of the second heat exchanger 8 is a third heat exchanger 10 to which drain conduits 11 are likewise connected for carrying out measurements. In heat exchanger 10 the combustion gases are for instance further cooled from 300–400° C. to for instance 110° C., i.e. to a temperature above the dew point. In FIG. 1 an outlet conduit 12 for discharge of the combustion gases is connected to heat exchanger 10. In another preferred embodiment (not shown) a condensation apparatus, for instance of stainless steel, would also be connected hereto for further cooling of the combustion gases to below the dew point.

Figure 2:
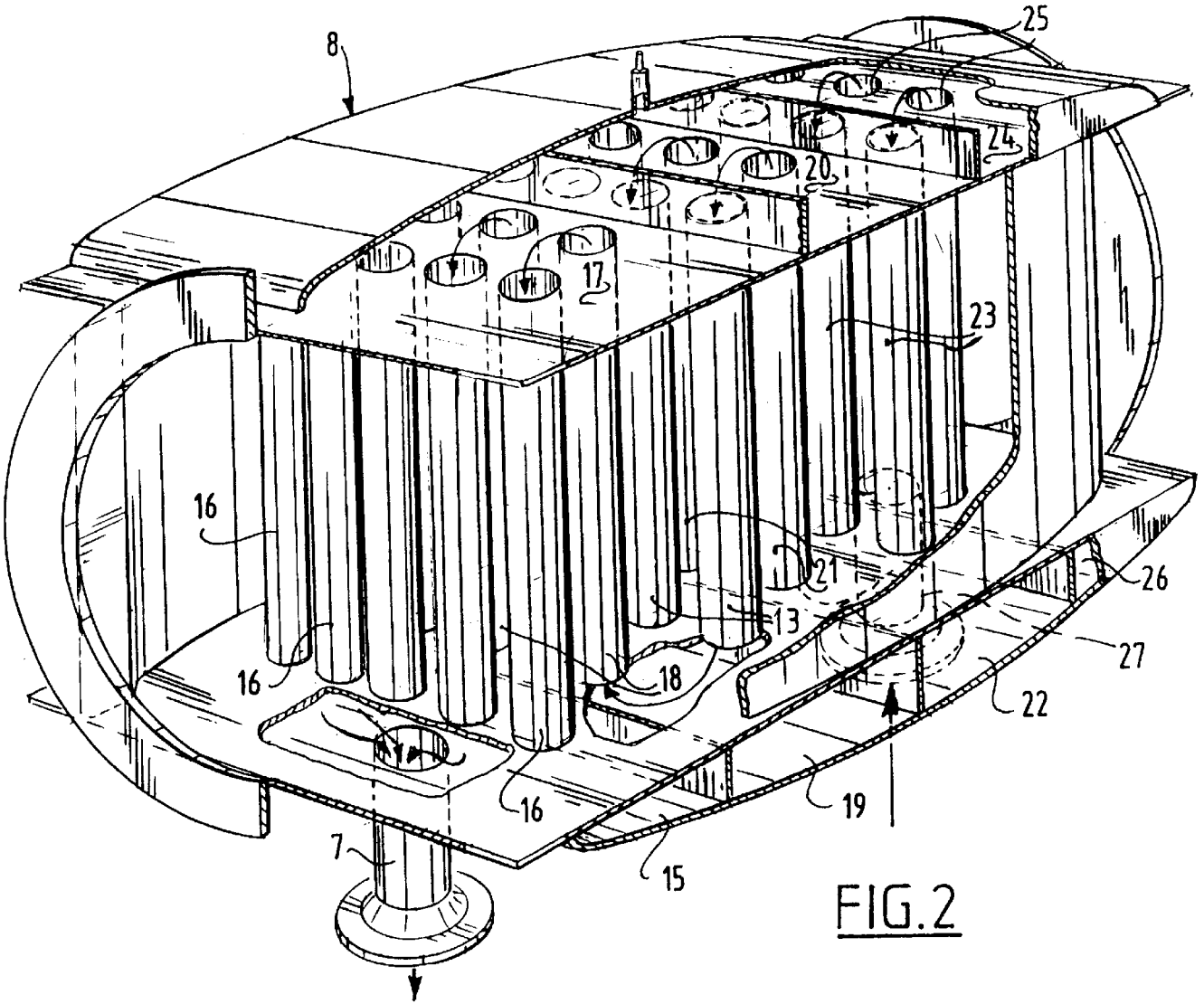
FIG. 2 is a partly cut-away view in perspective of a part of the embodiment of FIG. 1.

As shown in FIG. 2, the water for heating is fed to heat exchanger 8 via conduit 27 into a space 26 onto which debouch a number of standing pipes 25 which debouch on the other side into a space 24 onto which connects a second layer of pipes 23 which debouch on the other side into space 22, from which pipes 21 then extend into space 20 which is in communication with space 19 via pipes 13. Space 19 is in communication with space 17 via pipes 18 and, finally, with space 15 via pipes 16. The flow of the water is indicated using arrows. The pipes provided with a smooth outer wall in heat exchanger 8 extend substantially transversely of the flow direction of the combustion gases, while in an embodiment which is not shown it is conceivable for the pipes of one row to lie transversely of the preceding row of pipes.

In the above-described embodiment the pipes are disposed one after another in offset manner. It is also conceivable to dispose the pipes one after another in series. The general relationship below for coefficient of heat transfer applies according to the literature for both configurations, wherein C and m are the configuration-dependent factors.

$$\alpha = \frac{\lambda}{D} C Re_{D,\max}^{m} Pr^{0,36}$$

The Reynolds number $Re_{D,max}$ is herein based on the maximum velocity $V_{max}$.

For the pressure drop Δp, the following formula applies:

$$\Delta p = N \chi \xi \frac{\rho}{2} V_{\max}^2$$

wherein:

N is the number of pipes $$\xi \text{ is the friction factor} = f\left(\frac{S_y}{S_x}, Re_{D,\max}\right)$$

$$\chi \text{ is the pitch ratio factor} = f\left(\frac{S_y}{D}, Re_{D,\max}\right),$$

wherein χ in the lower Reynolds range $Re_{D,max}$<than 20,000 is practically constant and equal to 1. The friction factor ξ is related in a complex manner to the Reynolds number and the ratio of the pitch of the pipes in the direction parallel to the gas flow and the diameter of the tube D. The value hereof varies within the design range with a factor of about 2. Assuming a constant entry temperature, there finally remain three independent quantities which determine particularly the pressure, i.e. the number of pipes N, the Reynolds number $Re_{D,max}$ and the maximum velocity $V_{max}$.

In accordance with the above formulae, a series of heating devices can be designed in a capacity range of 0.5–15 MW, wherein even at the highest capacity the total length of the second and third heat exchanger together is no greater than 1.5 m.

Figure 3:
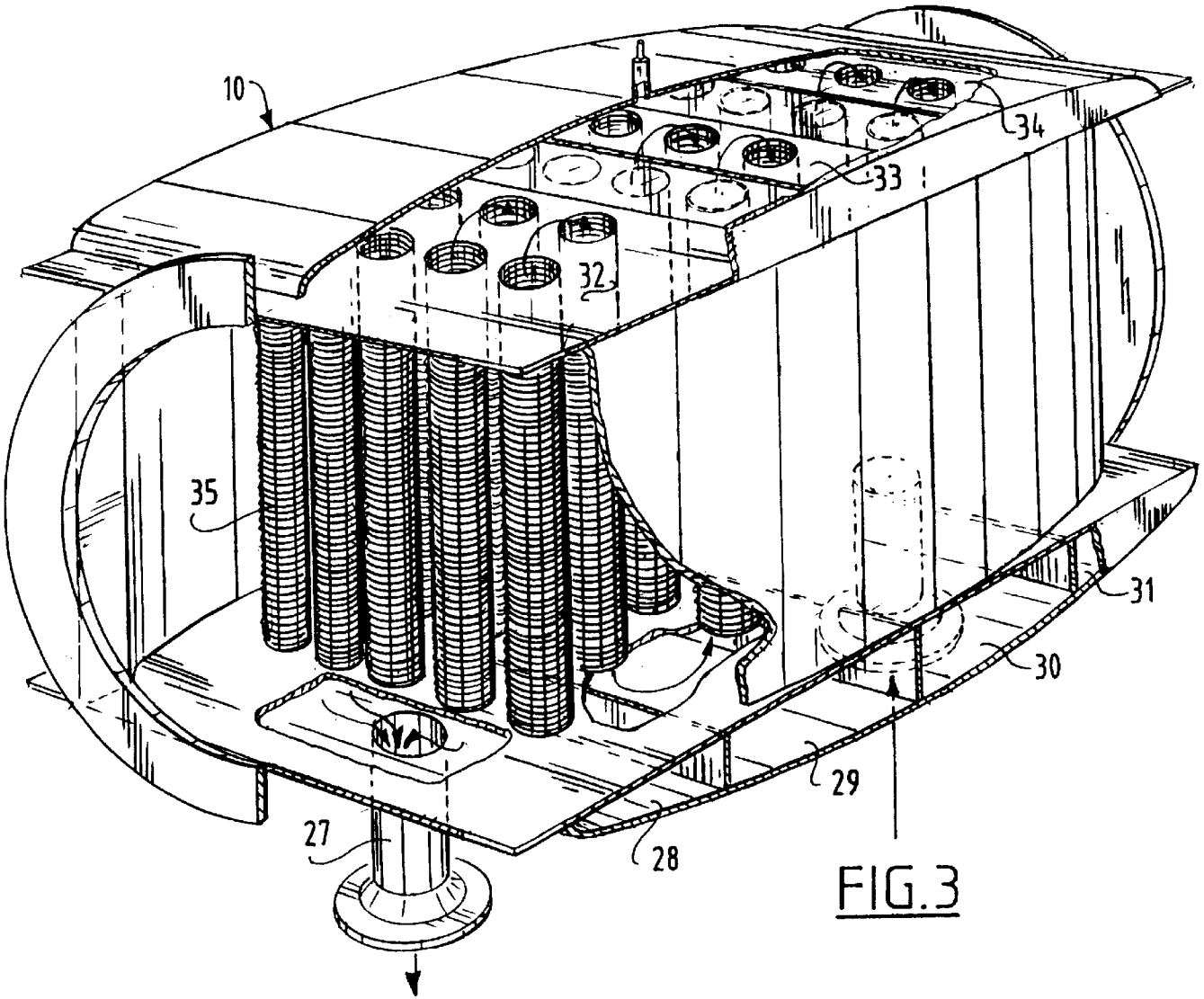
FIG. 3 is a partly cut-away view in perspective of a part of the device shown in FIG. 1.

As shown in FIGS. 1 and 3, space 26 communicates via pipes 27 with the third heat exchanger 10, wherein in similar manner the spaces 28, 29, 30 and 31 communicate with spaces 32, 33 and 34, while ribbed pipes 35 extend in each case between these spaces. Because of the considerably smaller temperature difference in the third heat exchanger the pipes thereof are provided with fins in order to enlarge the heat-exchanging surface. The water flow is once again indicated using arrows.

Figure 4:
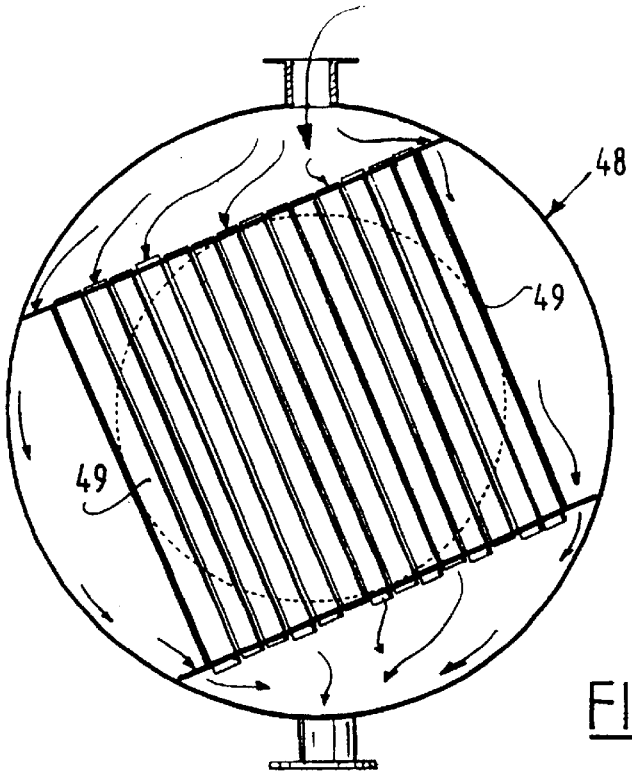
FIG. 4 shows a schematic view of a part of an alternative embodiment of a device according to the present invention.

FIG. 4 shows an alternative arrangement of a heat exchanger 48 in which smooth pipes 49 are disposed at an angle to the horizontal so as to enhance the discharge of any condensation which may form.

Figure 5:
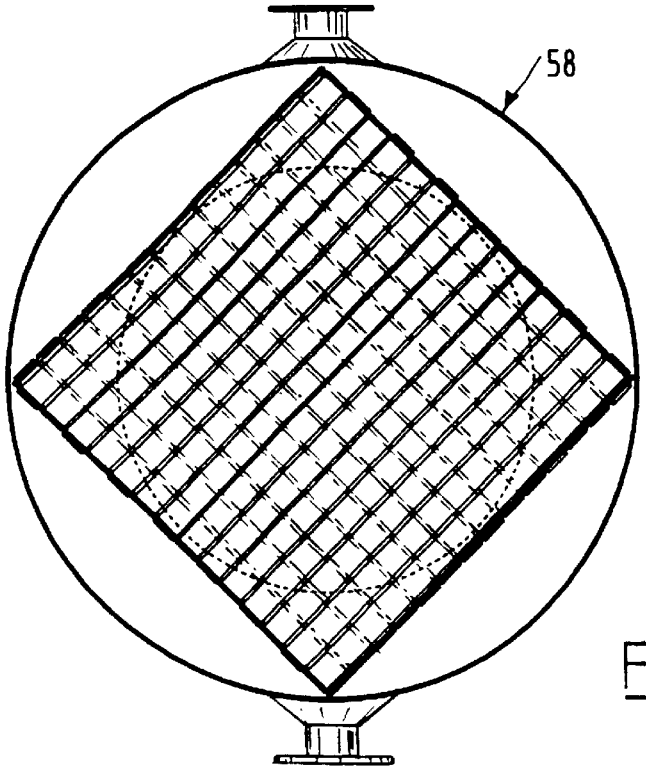
FIG. 5 shows a schematic view of a part of an alternative preferred embodiment of a device according to the present invention.

FIG. 5 shows the configuration wherein packages of pipes in a heat exchanger 58 are disposed crosswise one after another at an angle of 45°. This arrangement has the further advantage that the volume flow through the diverse pipes is the same, which is important in minimizing thermal stresses in the design and a more uniform distribution of the hydraulic and mechanical forces against the walls.

In a further preferred embodiment 61 (FIGS. 6–11) a spacious fire tube 63 is created by an inner casing 62. Rings 64, 65 and 66 are fixed to inner casing 62, wherein in each of the rings are arranged recesses which are preferably not disposed in line. The rings are held clear of an outer casing 67 (see also FIG. 9) in order to prevent thermal stresses. Rings 64, 65 and 66 serve to strengthen the construction and as baffles for the water flow between inner casing and outer casing.

As seen in the flow direction of the combustion gases, two packages of heat-exchanging pipes 69 respectively 70 are arranged behind a further baffle 84 provided with openings 68, wherein the first package 69 consists of heat-exchanging pipes in crosswise disposition having a smooth outer wall, while the pipes in crosswise disposition in package 70 are provided with ribs. Section 69 acts to cool the combustion gases in the range from about 1,000° C. to about 300° C., while the pipes in package 70 are intended for cooling from about 300° C. to about 110° C., i.e. just above the dew point. The medium for heating, in the present case water, is supplied via connecting stub 71 on outer casing 67, while it is discharged via connecting stub 72 on outer casing 67.

Figure 7:
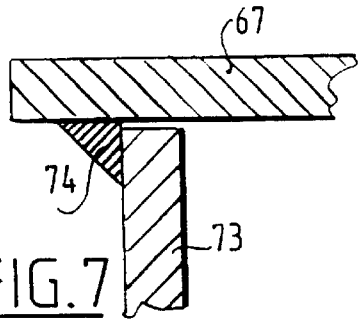
FIGS. 7, 8 and 9 show cross-sectional views of detail VII, VIII respectively IX of FIG. 6.
Figure 8:
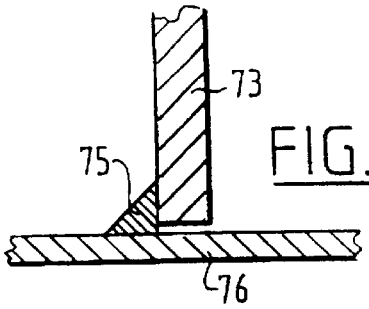
Figure 9:
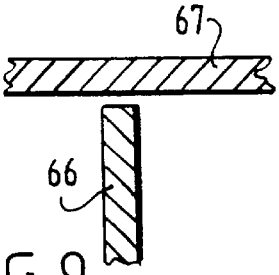
Figure 10:
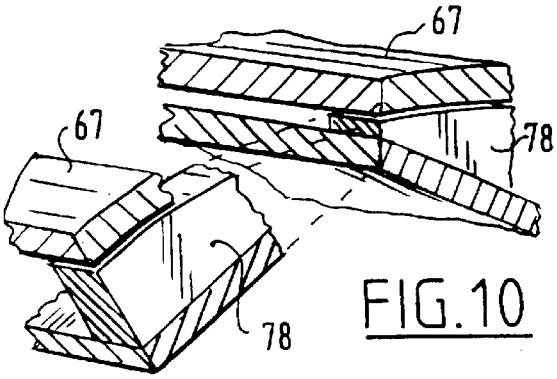
FIGS. 10 and 11 show partly broken away views in perspective of detail X respectively XI of FIG. 6.

A boiler front end 73 is welded to the outer wall 67 and to a feed 76 for the medium for heating using two annular welds 74 respectively 75 (see FIGS. 7 and 8). A partition 78 separating section 69 from section 70 is held clear of outer wall 67.

Figure 6:
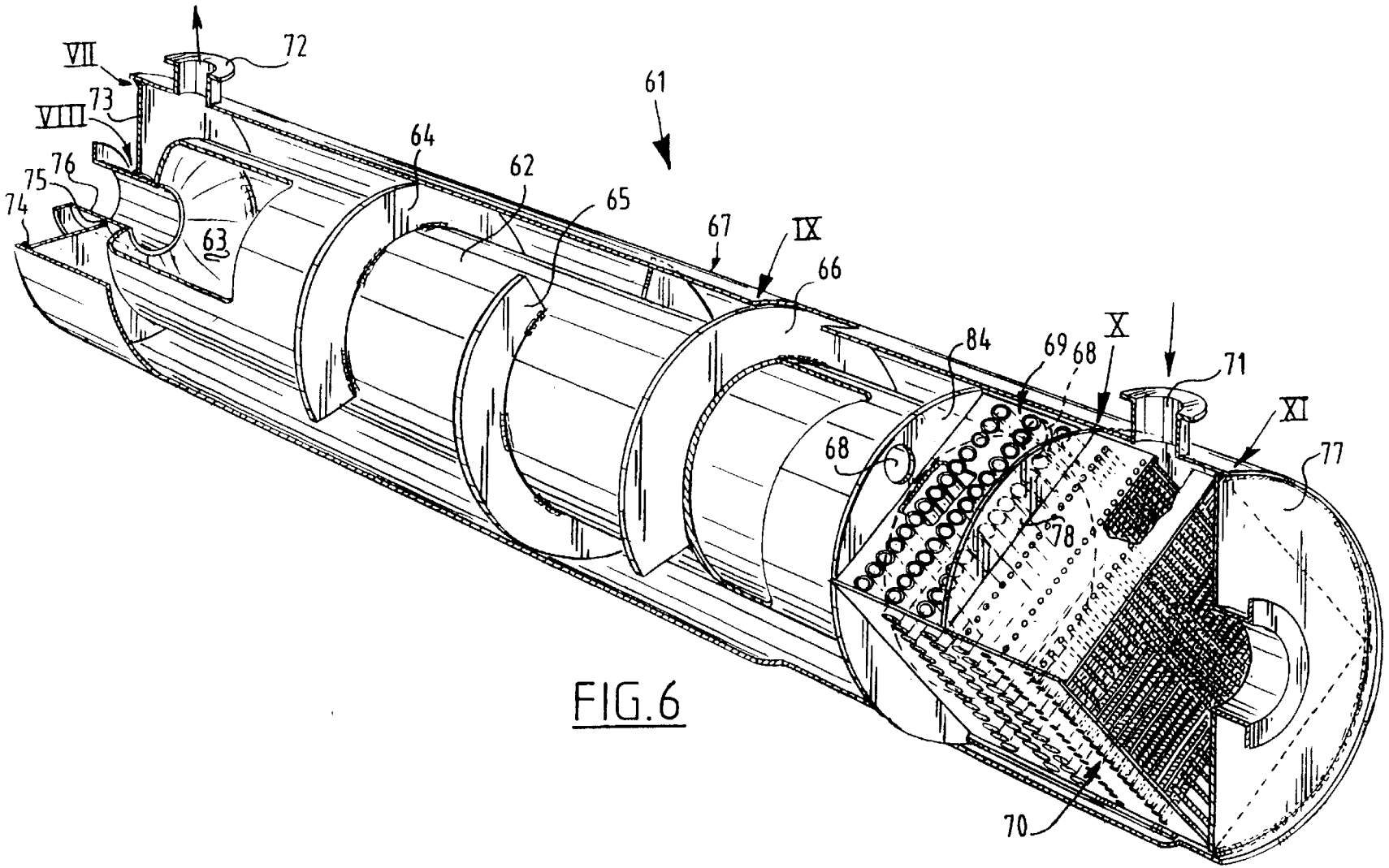
FIG. 6 is a partly cut-away view in perspective of a further preferred embodiment of a device according to the present invention.
Figure 11:
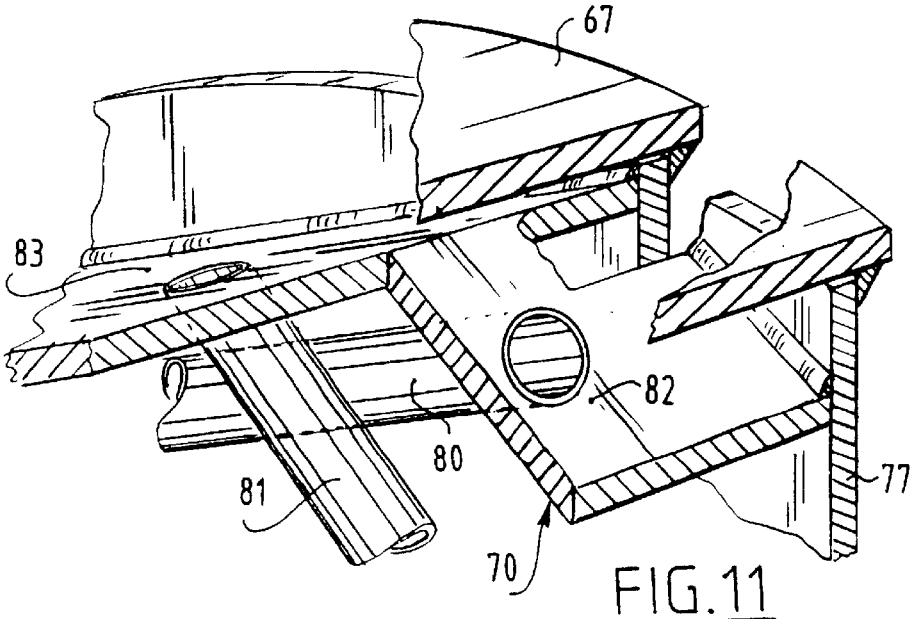

As shown particularly in FIG. 6 and FIG. 11, a so-called header section is formed by the arrangement of substantially square pipe sections 69 and 70 each with crosswise pipes, of which pipes 80 and 81 are shown in FIG. 11 which are arranged in pipe plates 82 respectively 83, whereby the flow from connecting stub 71 takes place uniformly and the construction is simplified.

Figure 12:
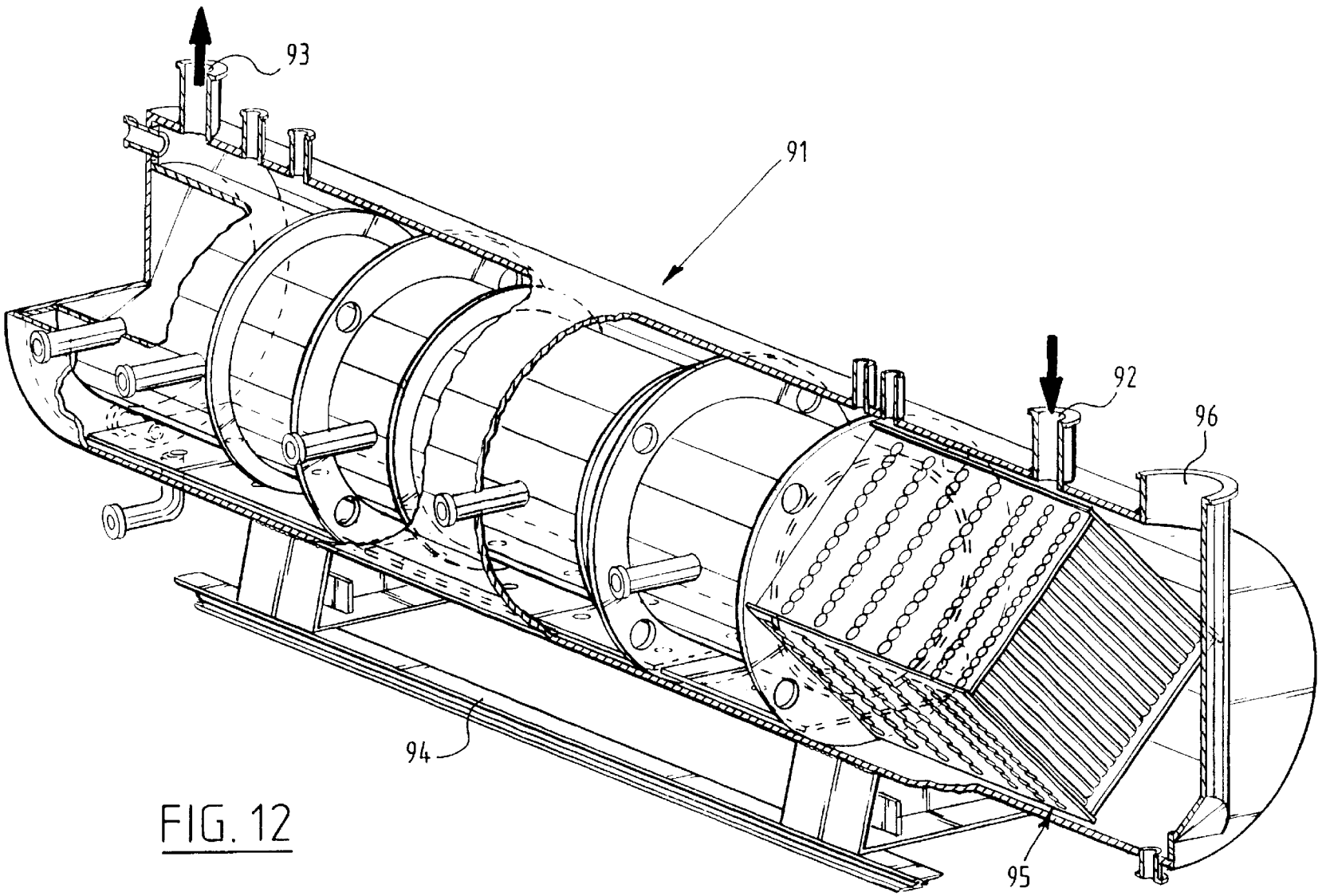
FIG. 12 is a partly cut-away alternative of a further preferred embodiment of the device according to the present invention.
Figure 13:
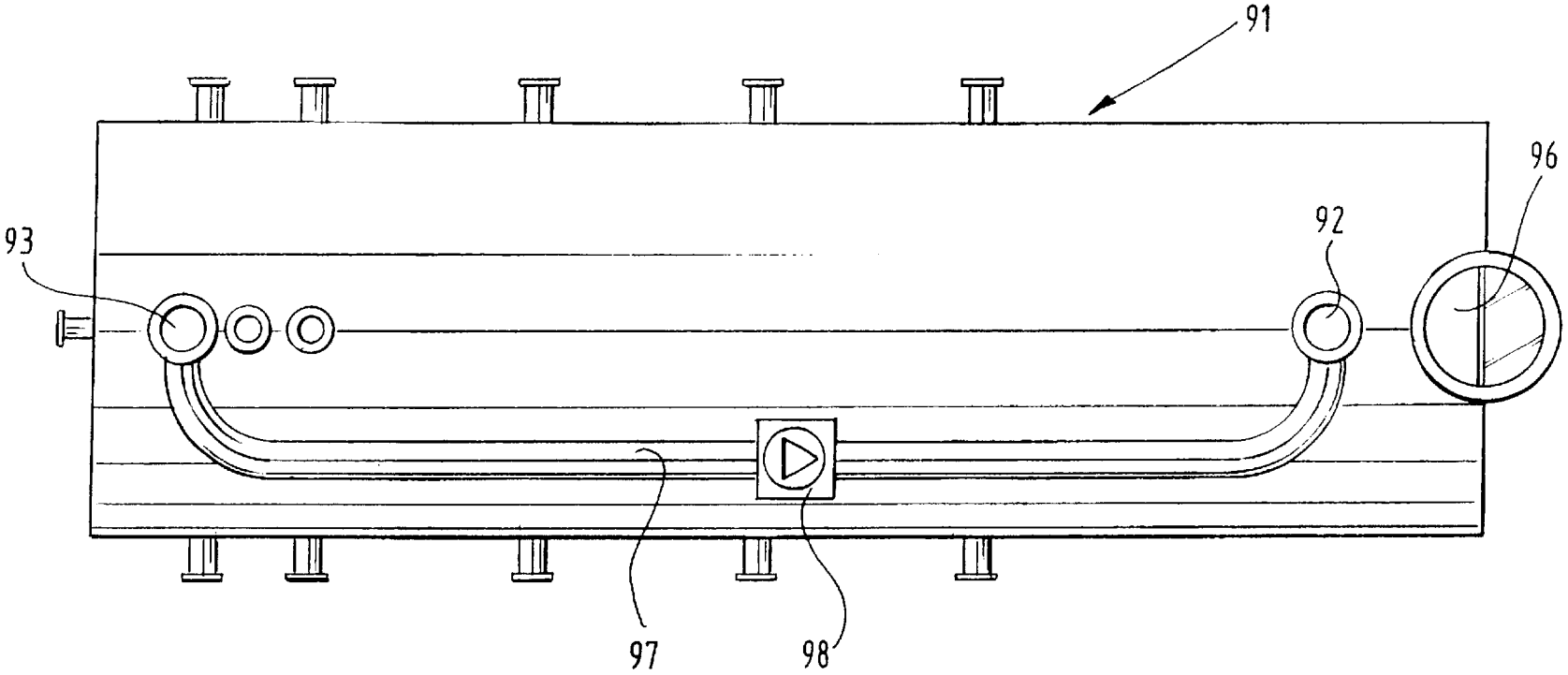
FIG. 13 is a schematic top view of the preferred embodiment shown in FIG. 12.

A most recent preferred embodiment 91 (FIGS. 12, 13) comprises a connecting stub 92 for the fluid for heating and a connecting stub 93 for discharge of heated medium. The device is further placed horizontally on a foot frame 94, while a pipe section 95 is placed close to an outlet opening 96 for the flue gases.

In this preferred embodiment a return or shunt conduit 97 with a pump 98 therein is arranged between out-feed stub 93 and in-feed stub 92 in order to feed some of the heated fluid back to the section of heat exchanger 95. Particularly at low load of device 91 it is thus possible to ensure that the temperature difference of the fluid for heating amounts to no more than 20° C. and that with a correct regulation the temperature of the entering water does not fall below 60° C., whereby condensation of the flue gases is avoided.

In the above preferred embodiments about 30–40% of the heat transfer takes place in the part around the spacious fire tube.

The present invention is not limited to the above described preferred embodiment thereof; the rights applied for are defined by the content of the following claims, within the scope of which many modifications can be envisaged. A non-limitative modification relates for instance to an embodiment wherein condensation occurs in the boiler, wherein the second and third heat exchanger are disposed successively in something of a V-shape so that in the point of the V the condensed water can be drained.

What is claimed is:

1. Device for heating fluid, comprising:

a first section for heating the fluid in which fuel and air are mixed and combusted;

a second section for heating the fluid which is disposed substantially in the line of the combustion section and in which a number of pipes for the fluid extend substantially transversely of the flow direction of the combustion gases; and a third section for heating the fluid which is disposed substantially in the line of the second heating section and in which a number of pipes for the fluid extend substantially transversely of the flow direction of the combustion gases, wherein at least a number of the pipes in the third section are provided with ribs or fins enhancing the heat transfer;

characterized in that the first section comprises a space formed between outer casing 67 and inner casing 62 in which space the fluid is heated.

2. Device according to claim 1, in which the space has an annular form.

3. Device as claimed in claim 1, wherein the pipes in the second and third section are disposed in successive rows and wherein a pipe from one row is offset relative to a pipe from the preceding row.

4. Device as claimed in claim 3, wherein at least some of the pipes extend obliquely, preferably at an angle of about 45°, to the horizontal.

5. Device as claimed in claim 1, wherein at least some of the pipes in the second and/or the third section are disposed crosswise relative to another part of the pipes.

6. Device as claimed in claim 5, wherein at least some of the pipes extend obliquely, preferably at an angle of about 45°.

7. Device as claimed in claim 1, wherein in at least some of the first number of pipes one or more retardation members are arranged internally therein.

8. Device as claimed in claim 7, wherein strengthening means are arranged in the annular space for strengthening the construction.

9. Device as claimed in claim 8, wherein the strengthening means are formed by baffles provided with a flow passage.

10. Device as claimed in claim 1, wherein an outer wall thereof is substantially cylindrical and the second and third section have an approximately square form which is disposed obliquely to the horizontal in the substantially cylindrical space.

11. Device as claimed in claim 1, wherein the first, second and third sections are fixed to each other and are fixed to a substantially cylindrical outer wall only via a front end and back end.

12. Device as claimed in claim 11, wherein the front end and back end are fixed to the cylindrical outer casing using an annular weld.

13. Device as claimed in claim 1, wherein the first, second and third sections extend in substantially lying position.

14. Device as claimed in claim 1, provided with a return conduit for partial return of heated water from the outlet connection to the inlet connection of the device.

15. Device as claimed in claim 14, wherein a pump is arranged in the return conduit.

* * * * *